US007043952B2

(12) United States Patent
Kraus et al.

(10) Patent No.: US 7,043,952 B2
(45) Date of Patent: May 16, 2006

(54) METHOD AND APPARATUS FOR FORMING FLANGE CORNERS

(75) Inventors: Gerhard Kraus, Vienna (AT); Heinrich Daniel Dechamps, Avon, CT (US)

(73) Assignee: RSM. AT Kraus & Pleniger OEG (AT)

( * ) Notice: Subject to any disclaimer, the term of this patent is extended or adjusted under 35 U.S.C. 154(b) by 357 days.

(21) Appl. No.: 10/713,384

(22) Filed: Nov. 14, 2003

(65) Prior Publication Data

US 2005/0103079 A1 May 19, 2005

(51) Int. Cl.
*B21D 7/02* (2006.01)

(52) U.S. Cl. ..... 72/220; 72/214; 72/203

(58) Field of Classification Search ..... 72/220, 72/210, 322

See application file for complete search history.

(56) References Cited

U.S. PATENT DOCUMENTS

| | | | | |
|---|---|---|---|---|
| 307,357 | A | 10/1884 | Tweddell et al. | |
| 1,493,516 | A | 5/1924 | Bähle | |
| 2,175,679 | A | 10/1939 | Beatty | |
| 4,803,879 | A | 2/1989 | Crawford | |
| 5,715,721 | A | 2/1998 | Anders et al. | |
| 5,765,427 | A | 6/1998 | Codatto | |
| 5,953,951 | A | 9/1999 | Fujimoto et al. | |
| 6,047,585 | A | 4/2000 | Haslinger | |
| 6,477,880 | B1 | 11/2002 | Zimmer | |
| 6,715,329 | B1 * | 4/2004 | Hametner | 72/220 |

FOREIGN PATENT DOCUMENTS

| | | |
|---|---|---|
| DE | 40 09 466 A1 | 9/1991 |

* cited by examiner

*Primary Examiner*—Derris H. Banks
*Assistant Examiner*—Debra Wolfe

(57) ABSTRACT

A flange corner forming apparatus includes a die having a planar upper surface upon which a workpiece may be supported and side surfaces intersecting at a flange forming corner. A workpiece clamps the workpiece securely against the die with the flange corner of the workpiece extending along the corner of the die, and a forming roll cooperatively configured with respect to the flange forming corner and form the flange of the workpiece about the die corner. A wedge is movable between the workpiece and the die corner to support the flange as it is being formed by the roll. A controller controls the movement of the wedge, the forming roll and the clamp.

18 Claims, 5 Drawing Sheets

METHOD AND APPARATUS FOR FORMING FLANGE CORNERS

BACKGROUND OF THE INVENTION

The present invention relates to machines for forming the flanges of metal workpieces and, more particularly, the corners of such flanges.

As is well known, brake presses and the like are utilized to bend sheet metal to provide flanges extending about only a portion of the periphery of a panel or about the entire periphery as may be desired. Some panel forming operations notch a portion of the blank at the corners to facilitate bending and avoid crenulated or serpentine corners. However, a closed corner in the panel may then only be facilitated by subsequent welding.

To provide closed, straight corners for unbroken flanges from solid material without welding, flange corner forming machines have been developed which smooth or flatten the crenulated corner areas produced in a brake press forming of the flange. Illustrative of such machines are German Patent AS 40 09 466 and U.S. Pat. No. 6,047,585. A workpiece which has been formed with crenulated corners is placed within such a machine and the corner areas are profiled to provide a substantially vertical flange corner. These machines use the combination of a forming roll and a die upon which the workpiece is supported. As the forming roll is moved along the corner flange of the workpiece, it forces the metal of the flange against the surface of the die and forms the metal of the flange adjacent the corner. Subsequently, the workpiece is generally transferred to a shear wherein excess metal at the corners of the flange is removed.

Although such machines have proven useful in the forming of flange corners on metal workpieces, the height of the flange which can be effectively processed is limited and it will often vary with the metal composition and thickness.

It is an object of the present invention to provide a novel flange corner forming machine which enables the formation of flange corners of greater height to material thickness ratio for a given material than are presently obtainable.

It is also an object to provide such a flange corner forming machine which is rugged in construction and efficient in its operation.

A further object is to provide such a flange corner forming machine in which the tooling can be readily interchanged for workpieces of different metal composition and thickness, and for flanges of different heights.

A still further object is to provide a novel method for forming sheet metal flanges to provide smooth vertical corners with solid material integrity and without the requirement of welding.

SUMMARY OF THE INVENTION

It has now been found that the foregoing and related objects may be readily attained in a flange corner forming apparatus comprising a die having a planar upper surface upon which a workpiece may be supported and having side surfaces intersecting at a flange forming corner and workpiece clamping means for clamping the workpiece securely against the planar surface of the die with the flange corner of the workpiece extending along the corner of the die. A forming roll is cooperatively configured with respect to the flange forming corner and adapted to form the flange of the workpiece about the die corner, and a wedge is movable between the workpiece and the die corner. There are also provided means for moving the clamping means to clamp the workpiece against the die, means for moving the forming roll relative to the die and in an axis generally parallel to the flange forming corner, and means for moving the wedge between the die and the workpiece. Control means is also provided for controlling the movement means for the wedge, the forming roll and the clamping means.

Preferably, the movement means include piston/cylinder assemblies. The movement means for the wedge moves the wedge as the movement means for the forming roll moves the roll, and the movement of the wedge may be at a velocity or orientation equal to or different from that of the forming roll. If desired, the movement of the wedge may be continuous or incremental, and the movement of the wedge may be initiated with, before or after initial movement of the forming roll.

Desirably, the clamping means is a pressure foot and there is included a shear cooperating with the die to trim the edge portion of the workpiece flange. The forming roll has a circumferential groove with sloping sides to conform substantially to the corner and adjacent side surfaces of the die. The wedge has a generally V-shaped groove substantially conforming to the die corner and slidable thereon.

The method for forming the corner of a flange on a workpiece includes the steps of providing a sheet metal workpiece having a flange extending along at least two sides thereof and forming corner, and clamping the workpiece on a die having intersecting side surfaces intersecting in a corner configuration approximating the desired flange corner configuration for the workpiece and with the workpiece flange extending along the side surfaces thereof.

A forming roll having a configuration closely approximating that desired for the finished corner of the flange, moved against and along the flange corner of the workpiece. This movement of the forming roll forces the flange against the corner and side surfaces of the die. A wedge also having a configuration approximating the contour desired for the corner of the flange of the workpiece is disposed between the die and the workpiece flange. The wedge and the forming roll are moved downwardly to form the flange about the die corner.

The wedge and the forming roll may be moved concurrently as the flange is being formed by movement of the forming roll, and the wedge may be moved downwardly at a rate differing from that of the forming roll. The movement of the wedge may also be initiated after movement of the forming roll.

Desirably, subsequent to the forming of the flange, a shear is moved to cooperate with the die to trim the edge portion of the flange.

DETAILED DESCRIPTION OF THE ILLUSTRATED EMBODIMENT

Figure 1:
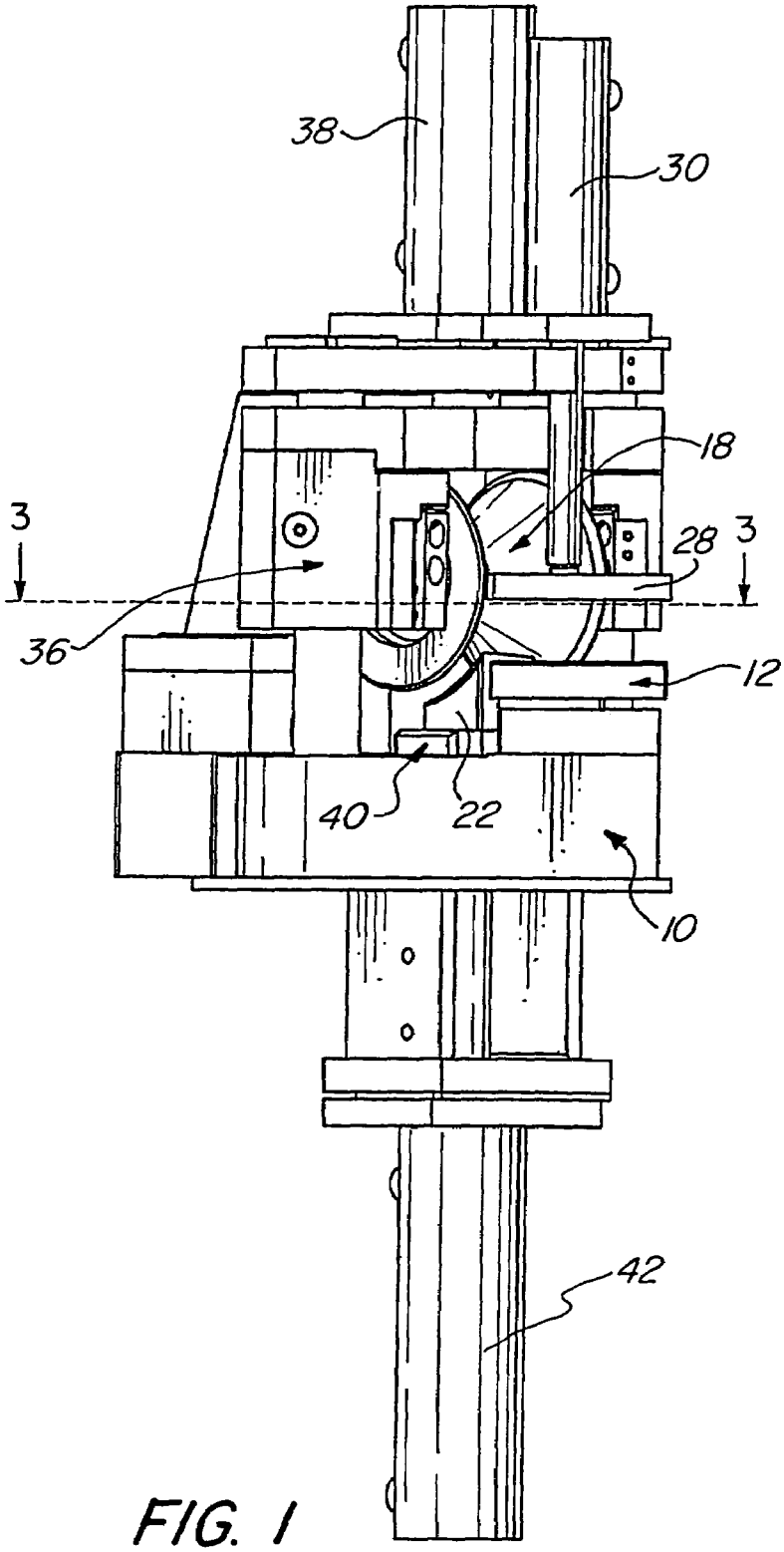
FIG. 1 is a front elevational view of the operational portion of a flange corner forming machine embodying the present invention.
Figure 2:
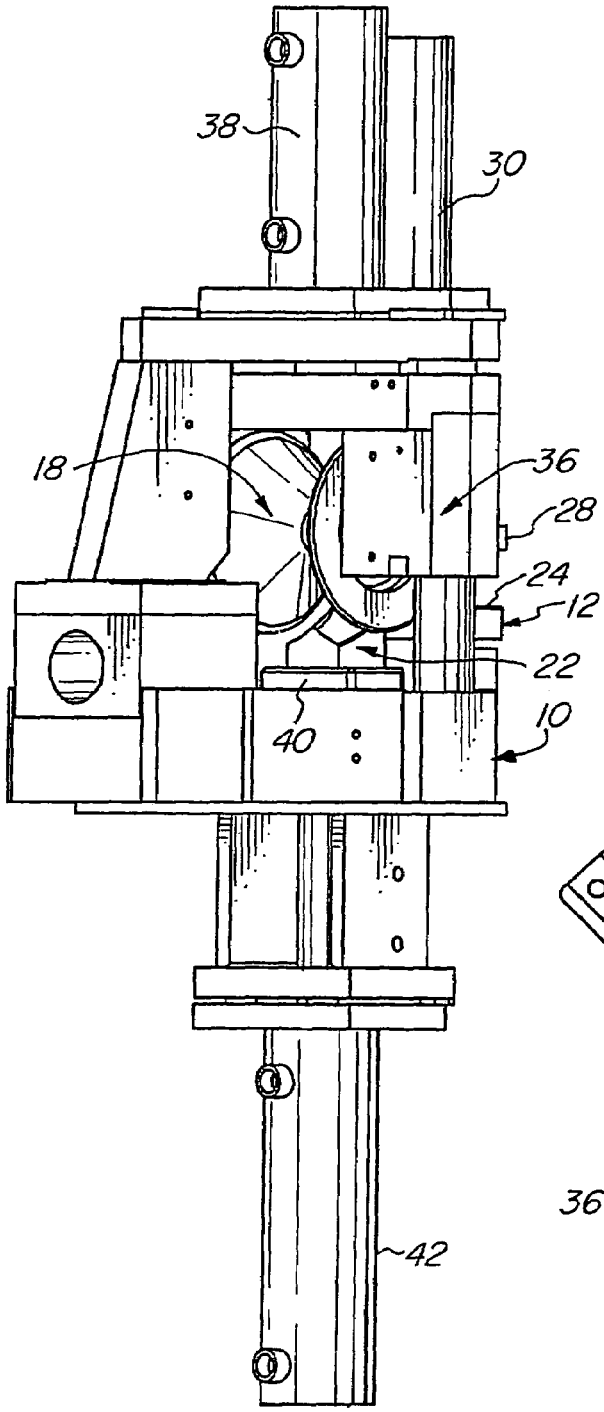
FIG. 2 is a side elevational view thereof.
Figure 3:
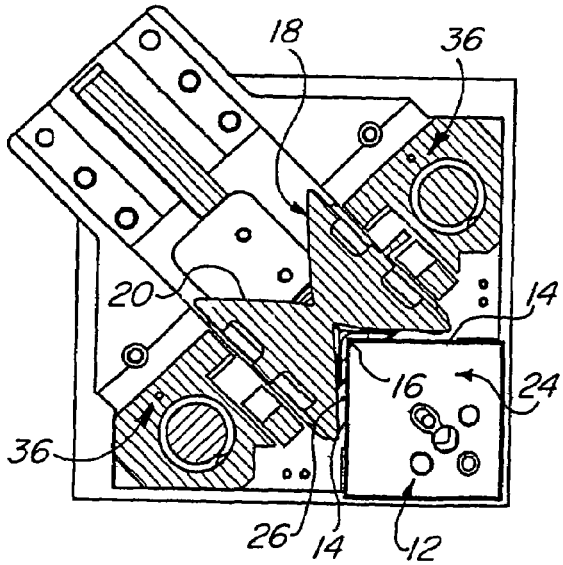
FIG. 3 is a sectional view thereof along the line 3—3 of FIG. 1.

As seen in FIGS. 1–3, a corner flange forming machine embodying the present invention is comprised of a frame 10 supporting thereon a die generally designated by the numeral 12 having side surfaces 14 intersecting at a corner 16, a forming roll generally designated by the numeral 18 and having a circumferential groove 20, and a wedge generally designated by the numeral 22. A sheet metal workpiece generally designated by the numeral 24 is supported on the die 12 with the flange 26 extending downwardly along the side surface 14 of the die 12.

The workpiece 24 is clamped firmly against the die 12 by the pressure foot 28 which is moved upwardly and downwardly by the actuating piston/cylinder assembly 30. The forming roll 18 is rotatable about a horizontal axis on bearings 32 supported by a vertical carriage 36. The forming roll 18 and its support 36 are movable in a vertical axis by the piston/cylinder assembly 38. The support 40 for the wedge 22 is movable in a vertical axis by the piston/cylinder assembly 42.

Figure 6:
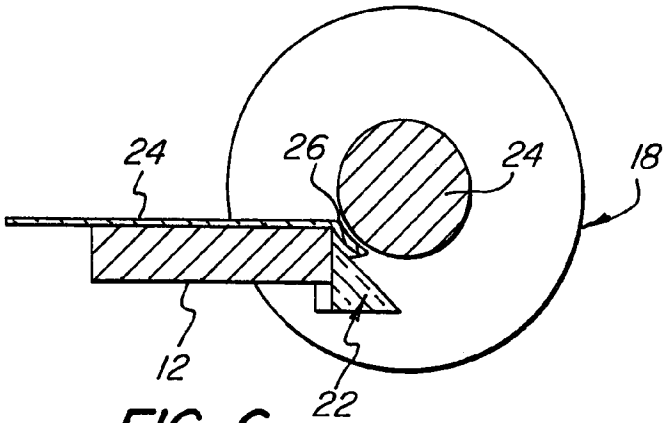
FIG. 6 is a similar sectional view along the line 6—6 of FIG. 5.
Figure 5:
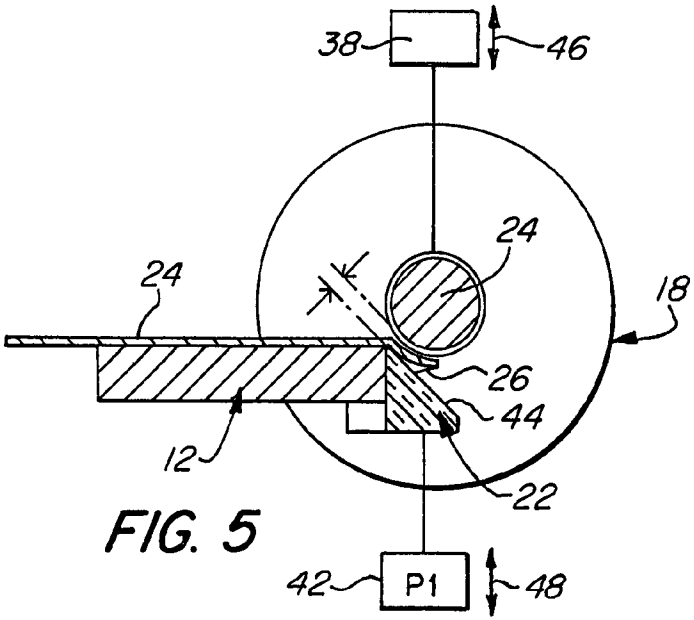
FIG. 5 is a sectional view along the line 5—5 of FIG. 4 and also showing the wedge and workpiece.
Figure 4:
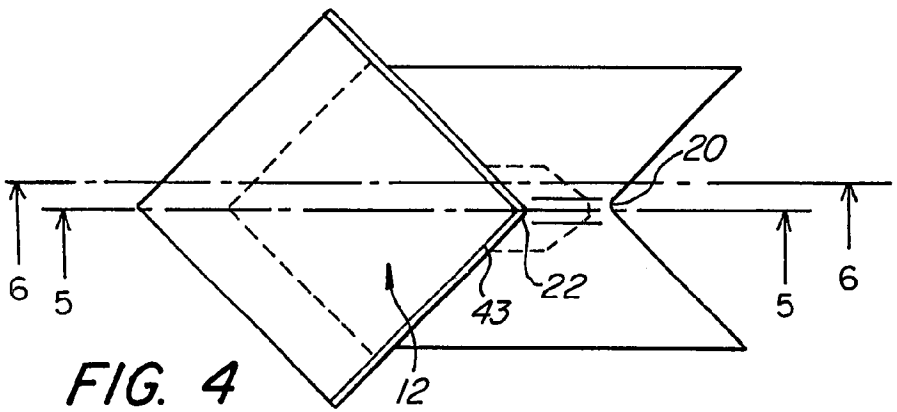
FIG. 4 is a diagrammatic top view of the forming roll and die.

The operation of the working components is illustrated in the diagrammatic illustrations of FIGS. 4–6. The die 12 has a corner approximating the desired configuration and the groove 20 of the forming roll 18 has a configuration 16 which cooperates with that of the corner 16 of the die 12. In this illustrated assembly, the wedge 22 has a generally triangular cross section and has a V-shaped groove 43 with vertical side surfaces which bear against the side surface 14 of the die 12 and an angular surface 44 which is disposed adjacent the flange 26 of the workpiece 24.

As illustrated, the flange 26 on the workpiece 24 has been preformed into an acutely angled orientation which the machine and process are intended to modify into a substantially defined angular orientation relative to the body of the workpiece 24. As the roll 18 is moved downwardly as depicted by the arrow 46, it presses the flange 26 against the angular surface 44 of the wedge 22 to avoid a deformation of the flange 26 in horizontal direction, causing more material to flow downwardly in the forming process of the flange 26. The wedge 22 is moved downwardly as depicted by the arrow 48 and the roll 18 continues to press the flange 26 towards the side surface 14 of the corner 16 of the die 12 until it is essentially abutting the die surface 14. At that point, the piston/cylinder 38 moves the roll 18 upwardly, the wedge 22 may be moved downwardly by the piston/cylinder 42, and the pressure foot 28 is moved upwardly by the piston/cylinder 30 to allow the workpiece 24 to be removed from the die 12 and from the forming machine.

In some embodiments of the present invention, a shear blade cooperates with the die 12 to trim the edge portion of the flange 26 before the pressure foot 28 releases the workpiece. This saves the time for transferring the workpiece to a separate shear and the cost of such a shear.

By incorporating the movable wedge to cooperate with the forming roll less stress is produced in the metal of the corner as it is being drawn into the desired flat configuration. This reduction in stress allows the flange to be drawn to a greater height relative to material thickness than with the roll alone.

Figure 7:
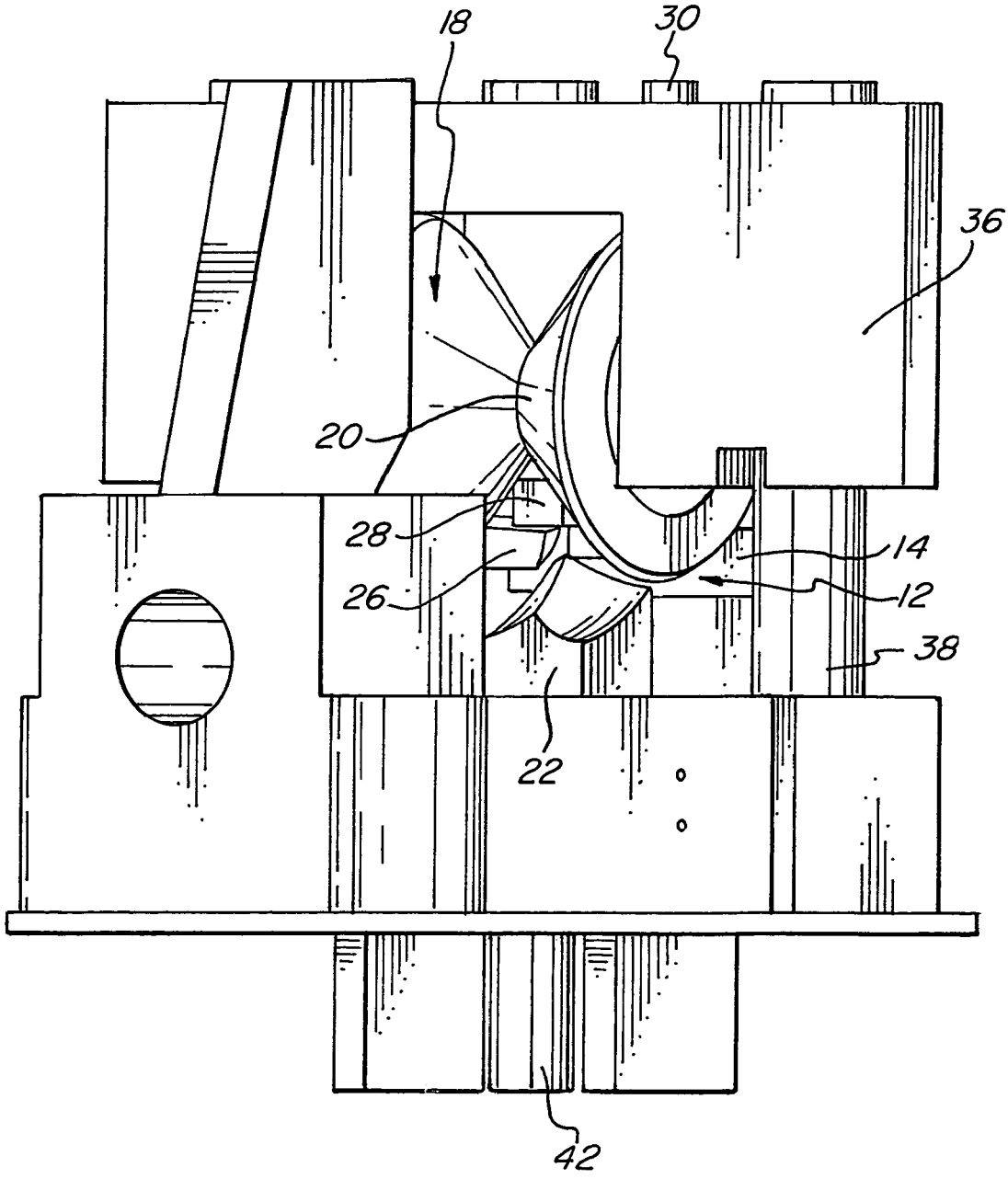
FIG. 7 is a vertical sectional view of the roller, wedge and workpiece drawn to an enlarged scale.
Figure 9:
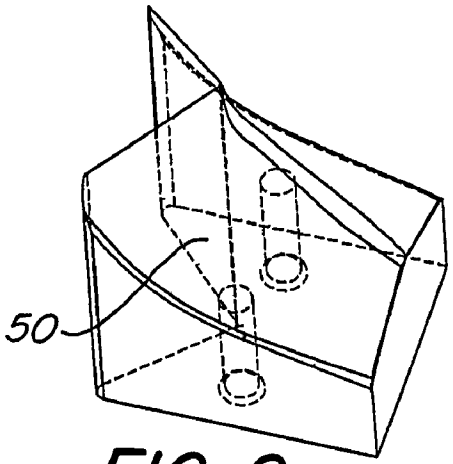
FIG. 9 is an isometric view thereof.
Figure 10:
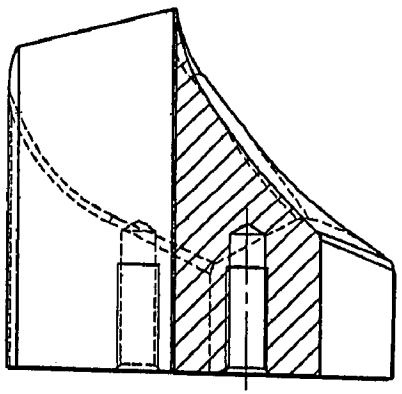
FIG. 10 is a sectional view thereof along the line 10—10 of FIG. 8.
Figure 11:
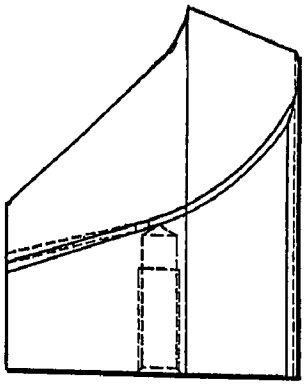
FIGS. 11 and 12 are side elevational views thereof.
Figure 12:
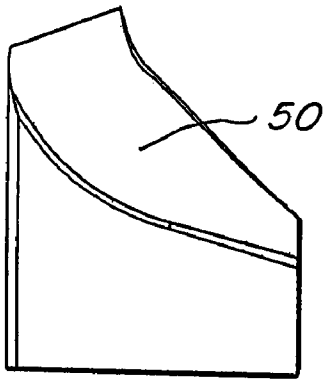
Figure 13:
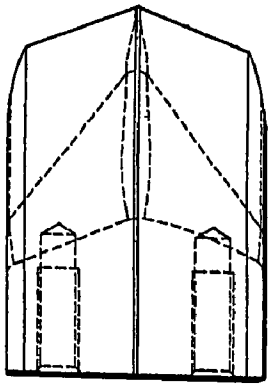
FIG. 13 is an end elevational view thereof.
Figure 8:
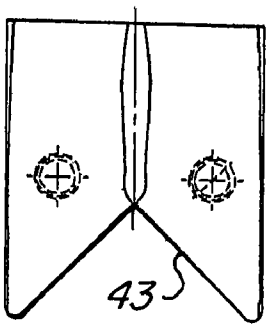
FIG. 8 is a bottom view of one embodiment of a wedge.

Turning next to FIG. 7, the several parts of the tooling and the workpiece are shown in section. The flange 26 of the workpiece 24 is being pressed by the forming roll 18 towards the die 12 and its lower end is bearing upon and supported by the wedge 22. As seen, the upper surface of the wedge 22 is arcuate to generally conform to the contour of the groove 20 in the forming roll 18.

As the forming roll 18 is moved downwardly, it bears directly upon the flange 26 to press it against the corner 16 and adjacent side surfaces 14 of the die 12. The wedge 22 provides support against the inside of the corner section of the workpiece flange 26 to restrict undesired deformation and it moves downwardly as the forming roll 18 effects the deformation of the flange 26 thereabove against the corner 16 of the die 12.

In some instances, the downward movement of the forming roll 18 and wedge 22 will be concurrent and at the same rate. In other instances, in a series of movements, the wedge 22 may be moved in increments downwardly to allow the forming roll 18 to press a portion of the flange 26 against the die 12, and then upwardly to support the workpiece flange 26.

In other instances, the motions of the forming roll 18 and wedge 22 may alternate.

Turning next to FIGS. 8–12, therein illustrated is one embodiment of a wedge 22*a*. As seen in the bottom view FIG. 8, the wedge 22*a* has at one end a V-shaped groove 48 with vertical side surfaces. As best seen in the isometric view of FIG. 9, it has a W-shaped surface defined by a pair of arcuate grooves 50 which intersect at the center of the surface. The surface relates to the curvature of the groove 20 in the forming roll 18 depending on material composition and thickness, and flange height.

As will be readily appreciated, the configuration of the groove in the forming roll will determine the outside radius of the corner. The inside corner radius will vary depending upon the thickness of the metal workpiece and is accommodated by the dimensioning of the die. The bending radius for the flange is determined by the bending dies of the press brake which preforms the flange on the workpiece. The flange radius is typically defined as the inside radius and the outside radius will vary with the thickness of the material.

The machine of the present invention is adapted to form flange corners with a wide range of bending radii and corner radii. A very small corner radius is 0.060–0.100 inch. A small to medium corner radius is 0.100–0.250 inch. Large corner radii are greater than 0.250 inch. Typically, small to medium corner radii will permit deeper flange/material thickness ratios than very small or large corner radii. Moreover, larger bending radii for the flange permit deeper flange/material thickness ratios. Accordingly, the maximum flange height is also dependent upon the bending radius of the flange and the corner radius, as well as the material and material thickness.

The following table illustrates flange corner heights which can be achieved with the machine of the present invention using a corner outside radius of 0.160 inch or 4 mm in materials up to 10 gauge thickness.

| Gauge | Flange Height (inch & metric) | | |
|---|---|---|---|
| Inch | | Material | |
| Metric | Cold Rolled | Stainless | Aluminum 3003 |
| 22 ga | | | |
| 0.299" | 0.54 | 0.51 | n/a |
| 0.76 mm | 13.7 | 12.9 | |
| 20 ga | | | |
| 0.0359" | 0.72 | 0.75 | 0.54 |
| 0.91 mm | 18.2 | 19.1 | 13.65 |
| 18 ga | | with C100 only | |
| 0.0478" | 1.2 | 1.15 | 0.72 |
| 1.21 mm | 30.3 | 29 | 18.15 |
| 16 ga | | with C100 only | |
| 0.0598" | 1.5 | 1.44 | 1.02 |
| 1.52 mm | 38 | 36.5 | 25.84 |
| 14 ga | | with C100 only | |
| 0.0747" | 1.57 | 1.57 | 1.34 |
| 1.90 mm | 40 | 40 | 34.2 |
| 13 ga | | | |
| 0.0897" | 1.57 | n/a | 1.57 |
| 2.28 mm | 40 | | 40 |
| 12 ga | | | |
| 0.1046" | 1.57 | n/a | 1.57 |
| 2.66 mm | 40 | | 40 |
| 11 ga | with C100 only | | |
| 0.1196" | 1.57 | n/a | 1.57 |
| 3.04 mm | 40 | | 40 |
| 10 ga | with C100 only | | |
| 0.1345" | 1.57 | n/a | 1.57 |
| 3.42 mm | 40 | | 40 |

As compared with the prior art machine of U.S. Pat. No. 6,047,585 which can achieve flange heights of approximately 15 times material thickness, the machine of the present invention can achieve flange heights of up to 25 times material thickness.

The rates of movement of the wedge and forming roll can be synchronized, or the wedge can be moved incrementally at a different rate. Moreover, the wedge may in some circumstances be moved in a direction opposite to that of the forming roll to wedge it under the workpiece flange. When processing aluminum, movement of the wedge desirably commences after the movement of the forming roll has begun. Moreover, the wedge may reciprocate to reposition the wedge during the movement of the forming. Generally, the rate of movement of the forming roll will be 100 inches per minute to allow the material of the flange to flow.

Although the wedge movement will normally be parallel to the motion of the forming roll, in some instances the wedge may be moved along an axis which deviates slightly from parallel to obtain the desired flow of the material in the vertical direction.

In the illustrated embodiment the movement of the components is being effected by hydraulic piston/cylinder assemblies. However, other drive systems may also be employed such as electric motor/gear drives.

The configuration of the surface of the wedge may be varied to facilitate the desired forming of the corner. It has a sloping surface of varying angularity to restrain flow of the material horizontally and to deter material from moving horizontally and to increase material flow downwardly.

To trim the edge of the corner following the forming step, the machine may include a shear blade which is movable against the flange and lower edge die to shear the flange to a uniform height.

Thus, it can be seen from the foregoing detailed description and attached drawings that the flange forming machine of the present invention enables the production of smooth radiused corners on a continuous flange which may be of greater height than presently available. The machine is rugged in construction and easy to operate. It may be readily adapted to accommodate different materials, different thicknesses and different heights.

What is claimed is:

1. Flange corner forming apparatus comprising:

(a) a die having a planar upper surface upon which a workpiece may be supported and having side surfaces intersecting at a flange forming corner;

(b) workpiece clamping means for clamping the workpiece securely against said planar surface of said die with the flange corner of the workpiece extending along said corner of said die;

(c) a forming roll cooperatively configured with respect to said flange forming corner and adapted to form the flange of said workpiece about said die corner;

(d) a wedge movable between the workpiece and said die corner;

(e) means for moving said clamping means to clamp the workpiece against said die;

(f) means for moving said forming roll relative to said die and in an axis generally parallel to said flange forming corner;

(g) means for moving said wedge between said die and the workpiece; and (h) control means for controlling the movement means for said wedge, said forming roll and said clamping means.

2. The flange corner forming apparatus in accordance with claim 1 wherein said movement means include piston/cylinder assemblies.

3. The flange corner forming apparatus in accordance with claim 1 wherein said movement means for said wedge moves said wedge as said movement means for said forming roll moves said roll.

4. The flange corner forming apparatus in accordance with claim 3 wherein said movement of said wedge is at a rate differing from that of said forming roll.

5. The flange corner forming apparatus in accordance with claim 1 wherein said movement of said wedge is incremental.

6. The flange corner forming apparatus in accordance with claim 1 wherein said movement of said wedge is initiated after initial movement of said forming roll.

7. The flange corner forming apparatus in accordance with claim 1 wherein said wedge is moved oppositely of said roll.

8. The flange corner forming apparatus in accordance with claim 1 wherein said clamping means is a pressure foot.

9. The flange corner forming apparatus in accordance with claim 1 wherein there is included a shear cooperating with said die to trim the edge portion of the workpiece flange.

10. The flange corner forming apparatus in accordance with claim 1 wherein said forming roll has a circumferential groove with sloping sides to conform substantially to the corner and adjacent side surfaces of said die.

11. The flange corner forming apparatus in accordance with claim 1 wherein said wedge has a generally V-shaped groove substantially conforming to said die corner and slidable thereon.

12. The flange corner forming apparatus in accordance with claim 1 wherein in said wedge has a sloped surface against which the flange bears to deter material from moving horizontally and to increase material flow downwardly.

13. In a method for forming the corner of a flange on a workpiece, the steps comprising;

(a) providing a sheet metal workpiece having a flange extending along at least two sides thereof and forming corner;

(b) clamping said workpiece on a die having intersecting side surfaces intersecting in a corner configuration approximating the desired flange corner configuration for said workpiece and with said workpiece flange extending along said side surfaces thereof;

(c) moving against and along said flange corner of said workpiece a forming roll having a configuration closely approximating that desired for the finished corner of said flange, said movement of said forming roll bending said flange against said corner and side surfaces of said die; and (d) locating between said die and said workpiece flange a wedge having a configuration approximating the contour desired for the corner of the flange of said workpiece, said wedge supporting said corner of said flange during said movement of said forming roll; and (e) moving said wedge and said forming roll downwardly to form said flange about said die corner.

14. The flange corner forming method in accordance with claim 13 wherein said wedge is moved in the same direction as said movement of said forming roll.

15. The flange corner forming method in accordance with claim 13 wherein said wedge and said forming roll are moved concurrently as said flange is being formed by movement of said forming roll.

16. The flange corner forming method in accordance with claim 13 wherein said wedge is moved downwardly at a rate differing from that of said forming roll.

17. The flange corner forming method in accordance with claim 13 wherein said movement of said wedge is initiated after movement of said forming roll.

18. The flange corner forming method in accordance with claim 13 wherein, subsequent to said forming of said flange, a shear is moved to cooperate with said die to trim the edge portion of the flange.

* * * * *